US008646776B2

(12) United States Patent
Agata et al.

(10) Patent No.: US 8,646,776 B2
(45) Date of Patent: Feb. 11, 2014

(54) IMAGE FORMING APPARATUS WITH REVERSELY-ROTATABLE ROLLER OF DIFFERENTIAL VELOCITIES

(75) Inventors: Jun Agata, Suntou-gun (JP); Kenji Matsuzaka, Suntou-gun (JP); Kouichi Yamada, Suntou-gun (JP); Masatoshi Takiguchi, Susono (JP); Ryukichi Inoue, Mishima (JP); Masahiko Suzumi, Numazu (JP); Jun Asami, Susono (JP); Sho Taguchi, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 261 days.

(21) Appl. No.: 12/968,696

(22) Filed: Dec. 15, 2010

(65) Prior Publication Data

US 2011/0156336 A1 Jun. 30, 2011

(30) Foreign Application Priority Data

Dec. 25, 2009 (JP) ..... 2009-295161

(51) Int. Cl.
*B65H 5/34* (2006.01)

(52) U.S. Cl.
CPC ..... *B65H 5/34* (2013.01); *Y10S 271/902* (2013.01)
USPC ..... 271/270; 271/186; 271/225; 271/902; 399/401

(58) Field of Classification Search
USPC ..... 271/184, 186, 225, 270, 902; 399/364, 399/401
See application file for complete search history.

(56) References Cited

U.S. PATENT DOCUMENTS

| | | | | |
|---|---|---|---|---|
| 4,000,942 | A | 1/1977 | Ito et al. | |
| 4,453,819 | A * | 6/1984 | Wada et al. | 271/186 |
| 4,487,506 | A * | 12/1984 | Repp et al. | 271/902 |
| 4,568,169 | A * | 2/1986 | Wada et al. | 271/186 |
| 4,918,490 | A * | 4/1990 | Stemmle | 399/401 |
| 5,337,135 | A * | 8/1994 | Malachowski et al. | 271/270 |
| 6,402,133 | B1 * | 6/2002 | Miyake | 271/186 |
| 6,626,428 | B2 * | 9/2003 | Soga et al. | 271/186 |
| 6,952,556 | B2 | 10/2005 | Endo et al. | |
| 2005/0251286 | A1 * | 11/2005 | Yasui | 271/186 |

FOREIGN PATENT DOCUMENTS

| | | |
|---|---|---|
| JP | 61-075369 | 4/1986 |
| JP | 2000-109275 | 4/2000 |
| JP | 2006-056682 | 3/2006 |
| JP | 2006056682 A * | 3/2006 |

* cited by examiner

*Primary Examiner* — Gerald McClain
(74) *Attorney, Agent, or Firm* — Fitzpatrick, Cella, Harper & Scinto

(57) ABSTRACT

A reversely-rotatable roller conveys a sheet having an image formed on its one side at a sheet conveying velocity faster than that of a conveying roller by normal rotation and then, the reversely-rotatable roller conveys the sheet to a re-conveying path by reverse rotation. The sheet conveying velocity of the reversely-rotatable roller when the reversely-rotatable roller reversely rotates is made slower than the sheet conveying velocity when the reversely-rotatable roller normally rotates so that the sheet conveying velocity of the re-conveying roller is substantially equal to or slower than the sheet conveying velocity of the conveying roller.

15 Claims, 9 Drawing Sheets

IMAGE FORMING APPARATUS WITH REVERSELY-ROTATABLE ROLLER OF DIFFERENTIAL VELOCITIES

BACKGROUND OF THE INVENTION

1. Field of the Invention

The present invention relates to an image forming apparatus.

2. Description of the Related Art

As a conventional image forming apparatus such as a copying machine, a laser beam printer, a facsimile machine, a word processor and a multi functional machine thereof, there is one which forms an image on a sheet using an electrophotographic system. In such an image forming apparatus, after an image is formed on one side (first side) of a sheet by an image forming portion, the sheet is again conveyed to the image forming portion, and an image is formed on the other side (second side) of the sheet.

To form an image on the second side of the sheet, the image forming apparatus which forms an image on both sides of a sheet includes a turn-over apparatus, a re-conveying path and a re-conveying roller to switch back a sheet having an image formed on its first side and to turn over the sheet. For example, an image forming apparatus such as a small printer includes, as the turn-over apparatus, a reversely-rotatable roller which can rotate normally and reversely, and when an image is formed on the second side of the sheet, the reversely-rotatable roller is rotated normally and reversely, and the sheet is conveyed to the re-conveying path while switching back the sheet (see Japanese Patent Application Laid-open No. 2000-109275). As the conventional image forming apparatus, to enhance the productivity when a sheet is turned over, there is an image forming apparatus in which the reversely-rotatable roller is driven by a motor capable of rotating normally and reversely, and a pulling velocity is changed by switch back according to a receiving velocity of the sheet (see Japanese Patent Application Laid-open No. 2006-56682).

In the case of an image forming apparatus such as a small printer, generally, a sheet is conveyed by a fixing device having a stable conveying force so that an image can be formed stably without depending on an image pattern and types of sheets. To suppress a curl of a sheet generated by heat applied to the sheet at the time of a fixing operation, the reversely-rotatable roller is made to convey the sheet at a faster velocity than the fixing device, the sheet is pulled and the curl is corrected (see Japanese Patent Application Laid-open No. 61-75369). In the case of such an image forming apparatus, a sheet conveying velocity is set such that the following relation is established: conveying roller velocity (before forming an image)≈(substantially equal) image forming velocity≤fixing velocity<reversely-rotatable roller velocity, so that an image can be formed stably and a curl can be corrected.

In the conventional image forming apparatus such as the small printer, when an image is formed on a first side, non-fixed toner adheres to a sheet in some cases. To form an image on a second side, if the sheet to which toner adheres is conveyed to the re-conveying path, the toner on the sheet adheres to the re-conveying roller provided on the re-conveying path, and an amount of toner adhering to the re-conveying roller is increased according to the number of sheets which pass.

As described above, the sheet conveying velocity of each sheet conveying portion has the relation of a conveying roller velocity (before forming an image)≈image forming velocity fixing≤velocity<reversely-rotatable roller velocity. A velocity relation between the reversely-rotatable roller and the conveying roller which are driven by the normally and reversely rotatable motor and which carry out switch back of a sheet is reversely-rotatable roller>>conveying roller. Here, if a velocity of the re-conveying roller which conveys a sheet which is switched back by the reversely-rotatable roller to the conveying roller is set to satisfy a relation of reversely-rotatable roller>re-conveying roller>conveying roller, a sheet forms a loop between the re-conveying roller and the conveying roller by a velocity difference.

If a sheet forms a loop, even after a rear end of the sheet passes through the re-conveying roller, the rear end of the sheet abuts against a surface of the re-conveying roller and slips for a while until the loop is eliminated. At that time, if toner of a certain level or more adheres to the re-conveying roller, toner adheres to the rear end of the sheet from the re-conveying roller due to this slip. As a result, a stain is generated on the rear end of the sheet during the re-feeding operation of the sheet, i.e., a tip end of the first side at a location which is contact with a roller outer periphery of the re-conveying roller. For example, a band-shaped stain having a roller width of 2 to 4 mm of the re-conveying roller is generated on the tip end of the first side.

If the velocity is set to satisfy a relation of re-conveying roller velocity<conveying roller velocity so that a sheet does not form a loop between the re-conveying roller and the conveying roller, a relation of reversely-rotatable roller velocity>>>re-conveying roller velocity is established, and an excessively large loop is generated between the reversely-rotatable roller and the re-conveying roller. If the excessively large loop is generated, the sheet is formed into an accordion shape at a location of the re-conveying path upstream of the re-conveying roller in the sheet conveying direction, a printing side of the sheet rubs against an inner surface of a conveying guide constituting the re-conveying path, and an image stain is generated. Since it is difficult to control a loop in the conveying guide, a sheet cannot be delivered to the re-conveying roller in an orderly fashion due to a curl generated at the fixing portion, and this can cause a paper jam.

The present invention has been accomplished in view of such circumstances, and the invention provides an image forming apparatus capable of forming images on both sides of a sheet without generating an image stain.

SUMMARY OF THE INVENTION

The invention has been accomplished in view of such circumstances, and the invention provides an image forming apparatus capable of forming images on both sides of a sheet in a state where a stain caused by toner is little.

The present invention provides an image forming apparatus including an image forming portion, a conveying roller which is provided upstream of the image forming portion in a sheet conveying direction, and which conveys a sheet to the image forming portion, a re-conveying path which conveys, to the image forming portion, a sheet having an image formed on its one side by the image forming portion, a normally and reversely rotatable reversely-rotatable roller which is provided downstream of the image forming portion in the sheet conveying direction, which normally rotates and conveys the sheet having the image formed on its one side at a sheet conveying velocity that is faster than that of the conveying roller and then, which reversely rotates and conveys the sheet to the re-conveying path, and a re-conveying roller which is provided on the re-conveying path, and which conveys the sheet to the conveying roller, wherein the sheet conveying velocity of the re-conveying roller is set substantially equal to or slower than the sheet conveying velocity of the conveying roller, and the sheet conveying velocity of the reversely-rotatable roller when it reversely rotates is slower than the sheet conveying velocity of the reversely-rotatable roller when it normally rotates so that the sheet conveying velocity of the reversely-rotatable roller when it reversely rotates becomes substantially equal to or slower than the sheet conveying velocity of the re-conveying roller.

By setting the sheet conveying velocity of the reversely-rotatable roller when the reversely-rotatable roller is reversely rotated slower than the sheet conveying velocity when the reversely-rotatable roller is normally rotated as in this invention, the sheet conveying velocity of the re-conveying roller can be substantially equal or slower than the sheet conveying velocity of the conveying roller. According to this, it is possible to form images on both sides of a sheet in a state where a strain caused by toner is little.

Further features of the present invention will become apparent from the following description of exemplary embodiments with reference to the attached drawings.

DESCRIPTION OF THE EMBODIMENTS

Figure 1:
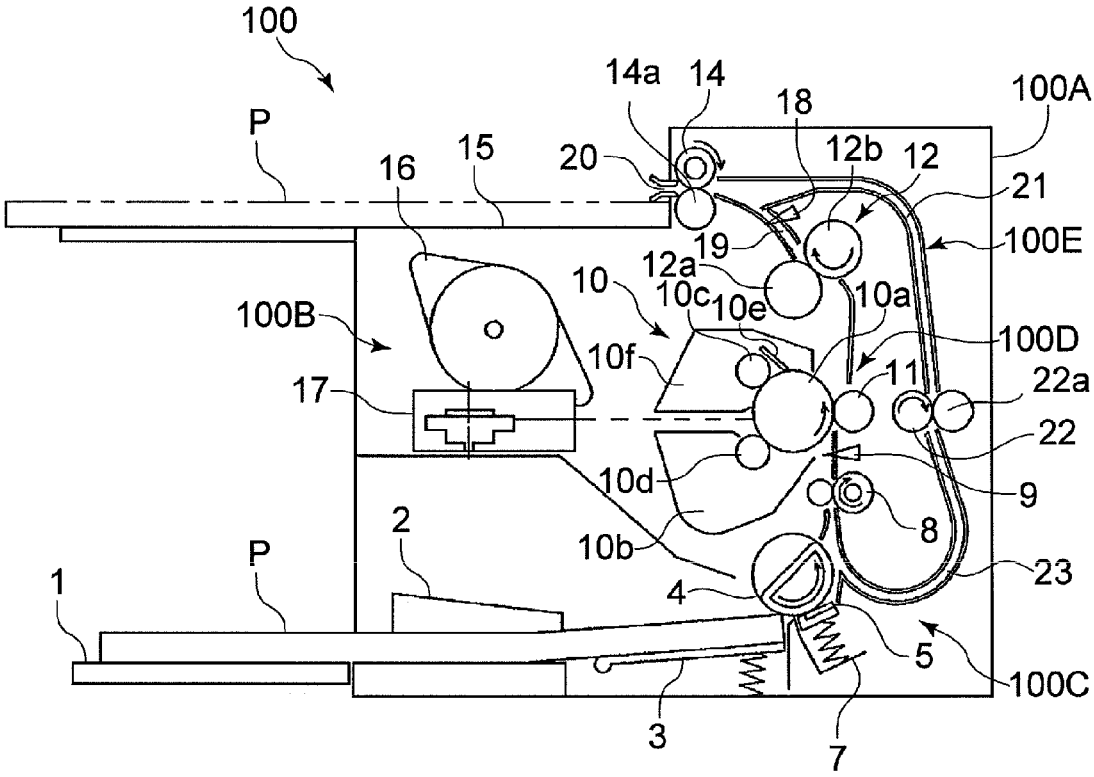
FIG. 1 is a diagram illustrating an outline configuration of a laser beam printer as one example of an image forming apparatus according to a first embodiment of the present invention.

Embodiments of the present invention will be described in detail using the drawings. FIG. 1 is a diagram illustrating an outline configuration of a laser beam printer as one example of an image forming apparatus according to a first embodiment of the invention.

FIG. 1 illustrates the laser beam printer 100 and a laser beam printer body (printer body, hereinafter) 100A which is an image forming apparatus body. The laser beam printer 100 includes an image forming portion 100B, a sheet feeding portion 100C which feeds sheets P to the image forming portion 100B, a transfer portion 100D, and a re-conveying portion 100E which again conveys a sheet having an image formed on its one side to the image forming portion 100B.

The image forming portion 100B includes a detachable process cartridge 10 integrally provided with process members such as a photosensitive drum 10*a* which is an image bearing member, a development sleeve 10*d*, a charging roller 10*c*, and a cleaning blade 10*e*. The image forming portion 100B includes a laser exposure apparatus 17 which exposes a surface of the photosensitive drum 10*a* to form an electrostatic latent image on the photosensitive drum.

The sheet feeding portion 100C includes a sheet tray 1 which can open and close and on which sheets P are stacked, a restricting plate 2 which restricts a position of a sheet P in a width direction intersecting with the sheet conveying direction, and a feeding roller 4 which feeds the sheets P on a sheet tray sheet by sheet. After the feeding roller 4 receives a sheet feeding-operation starting signal from a controlling portion (not illustrated) by a one-rotation controlling portion (not illustrated), the feeding roller 4 makes one rotation and feeds a sheet P toward the image forming portion 100B.

The transfer portion 100D includes the photosensitive drum 10*a*, and a transfer roller 11 which presses the photosensitive drum 10*a* to form a transfer nip, and which transfers a toner image on the photosensitive drum 10*a* to a sheet P when the sheet P passes through the transfer nip. The re-conveying portion 100E includes a re-conveying path 21 which turns over a sheet P and conveys the sheet P to the image forming portion 100B, a re-conveying roller 22 provided on the re-conveying path 21, and a merging conveying path 23 which conveys a sheet conveyed by the re-conveying roller 22 to a conveying roller 8. In FIG. 1, a main motor 16 drives the photosensitive drum 10*a*, the feeding roller 4, the conveying roller 8 and the re-conveying roller 22 as a driving source.

Next, an image forming operation in the laser beam printer 100 having the above-described configuration will be described.

When the image forming operation is started, the main motor 16 is rotated by a sheet feeding-operation starting signal from the controlling portion (not illustrated), and the feeding roller 4 rotates in a direction of the arrow. With this, a sheet feeding cam (not illustrated) which is coaxial with the feeding roller 4 also rotates, a sheet feeding plate 3 turns upward in association with a cam follower (not illustrated) which is engaged with the sheet feeding cam, and pushes a sheet P against the feeding roller 4. The feeding roller 4 sends out the sheet P by friction between the feeding roller 4 and the sheet P.

Meanwhile, when the feeding roller 4 rotates, the sheets P are separated at the same time by a separating pad 5 which is pressed against a separating pad spring 7. As a result, one sheet P is fed. A sheet feeding cam (not illustrated) which is coaxial with the feeding roller 4 pushes down the sheet feeding plate 3 to a sheet feeding standby position immediately before one rotation of the feeding roller 4 is completed. The sheet P which is fed by one rotation is conveyed by the conveying roller 8 provided upstream of the image forming portion 100B in the sheet conveying direction, and the sheet P turns a sheet tip end sensor 9. If the sheet tip end sensor 9 is turned in this manner, a photo sensor (not illustrated) is turned ON, and the controlling portion detects a tip end position of the sheet P. Thereafter, if a predetermined time is elapsed, the laser exposure apparatus 17 irradiates the photosensitive drum 10*a* with a laser beam based on image information.

If the image forming operation is started, the photosensitive drum 10*a* rotates in a direction of the arrow, and is uniformly charged by the charging roller 10*c* to a predetermined polarity and to predetermined potential. If the photosensitive drum 10*a* after its surface is charged as described above is irradiated with a laser beam, an electrostatic latent image is formed on the photosensitive drum 10*a*. Next, as the development sleeve 10*d* rotates, toner in the toner container

10*b* appropriately charged is supplied onto the photosensitive drum 10*a*, and the electrostatic latent image is developed and visualized as a toner image.

Next, the visualized toner image on the photosensitive drum is transferred to a sheet P by the transfer roller 11. Transfer residual toner not transferred and remained on the photosensitive drum is accommodated in a waste toner container 10*f* by the cleaning blade 10*e*, and the photosensitive drum 10*a* whose surface is cleaned is repeatedly used for a next image forming process. Next, the sheet P on which the toner image is formed is heated and pressed by a fixing portion 12 including a fixing heating member 12*a* and a fixing pressure roller 12*b*, and the toner image is permanently fixed on the sheet. Thereafter, the sheet P on which the toner image is fixed is discharged out from the printer body from a discharge opening 20 by a discharge roller 14 provided downstream of the image forming portion 100B in the sheet conveying direction and by a discharge rolling element 14*a* which follows the discharge roller 14. The sheet discharged from the discharge opening 20 is stacked on a discharge tray 15.

When images are formed on both sides of a sheet P, a reverse-rotation sensor 18 provided on a discharge conveying path 19 located between the discharge roller 14 and the fixing portion 12 detects a rear end of a sheet P and thereafter, the controlling portion (not illustrated) rotates the discharge roller in a direction opposite from the arrow at predetermined timing. According to this, the sheet P is switched back and reversely conveyed on the re-conveying path 21. Then, the sheet P is conveyed in the merging conveying path 23 by the re-conveying roller 22 and a re-conveying rolling element 22*a* which follows the re-conveying roller 22. The sheet conveyed by the re-conveying roller 22 is again guided to the conveying roller 8, the sheet is subjected to the image forming process which is the same as the one-sided printing, and the sheet is stacked on the discharge tray 15 by the discharge roller 14.

Figure 2:
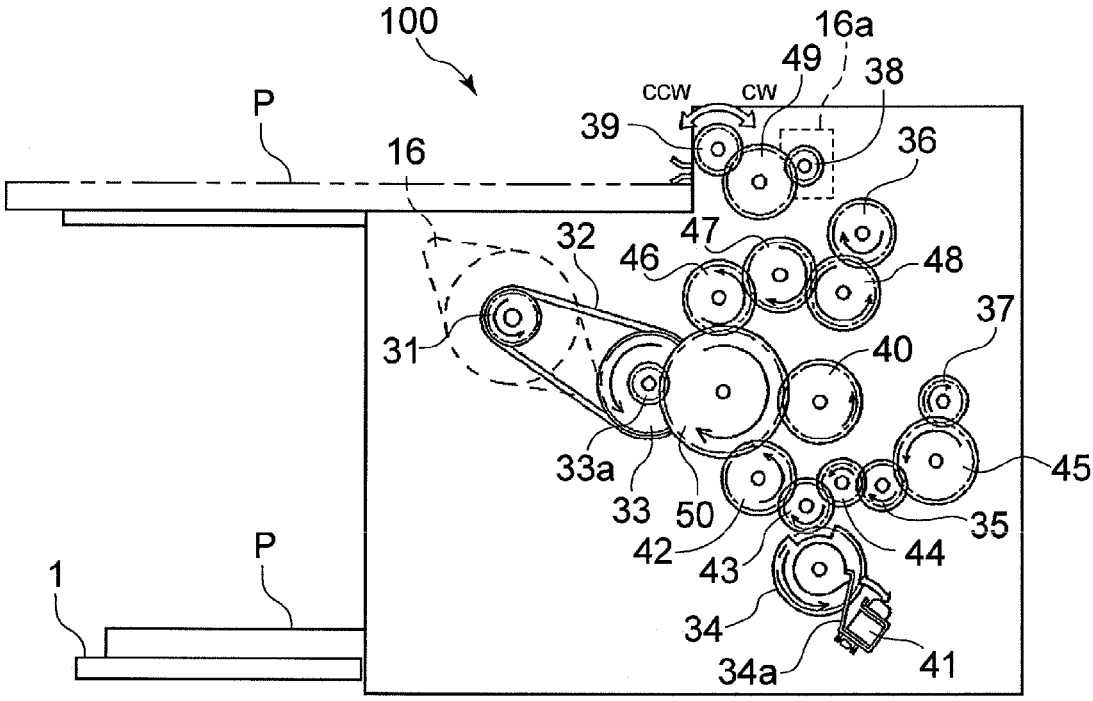
FIG. 2 is a diagram illustrating a drive transmitting system of the laser beam printer.

Next, the drive transmitting system which transmits a driving force from the main motor 16 to the feeding roller 4, the conveying roller 8, the re-conveying roller 22, the discharge roller 14 and the photosensitive drum 10*a* will be described using FIG. 2. In FIG. 2, rotation directions of gears are illustrated with arrows. In the case of the arrows showing only one direction, this means that the rotation direction is the same in both the one-sided printing and duplex printing.

The main motor 16 which is a first driving source fixed to a printer body 100A includes a motor pulley 31 which outputs rotation driving force of the main motor 16, and the motor pulley 31 is drive-connected to a deceleration pulley 33 through a drive belt 32. A deceleration gear 33*a* which transmits rotation transmitted from the drive belt 32 to a drive train located downstream is integrally formed on the deceleration pulley 33. The deceleration gear 33*a* is connected to a first idler gear 50, and the first idler gear 50 is drive-connected to a three-system drive train including a drum drive gear 40, a second idler gear 42 and a third idler gear 46. The drum drive gear is coaxially drive-connected to the photosensitive drum 10*a* through a coupling (not illustrated), and rotates the photosensitive drum 10*a*.

The second idler gear 42 transmits a driving force to the sheet feeding drive gear 34 through a fourth idler gear 43. The sheet feeding drive gear 34 is biased in a direction of the arrow by a biasing spring (not illustrated), and an engaging projection 34*a* of a solenoid 41 is engaged with the sheet feeding drive gear 34 against this biasing force. In a state where the engaging projection 34*a* is engaged, several teeth of the sheet feeding drive gear 34 are lost so that the sheet feeding drive gear 34 does not mesh with the fourth idler gear 43.

The solenoid 41 is operated when the sheet feeding operation is started, and engagement between the engaging projection 34*a* and the sheet feeding drive gear 34 is released, and if the engagement between the engaging projection 34*a* and the sheet feeding drive gear 34 is released, the sheet feeding drive gear 34 starts to rotate in the direction of the arrow by the biasing spring. As a result, the sheet feeding drive gear 34 is drive-connected to the fourth idler gear 43. Thereafter, if the sheet feeding drive gear 34 makes one rotation, the sheet feeding drive gear 34 and the engaging projection 34*a* of the solenoid 41 are again engaged with each other, and the sheet feeding drive gear 34 stops rotation. It is possible to intermittently drive the feeding roller 4 at any timing by such control of the solenoid 41.

The fourth idler gear 43 transmits a driving force to a conveying roller drive gear 35 fixed to the conveying roller 8 through a fifth idler gear 44. The conveying roller drive gear 35 transmits a driving force to a re-conveying roller drive gear 37 fixed to the re-conveying roller 22 through a sixth idler gear 45. The third idler gear 46 transmits a driving force to a pressure roller drive gear 36 which rotates the fixing pressure roller 12*b* of the fixing portion 12 through seventh and eighth idler gears 47 and 48.

In FIG. 2, a discharge driving motor 16*a* normally and reversely rotates a discharge roller 14 which is a reversely-rotatable roller. The discharge driving motor 16*a* can normally and reversely rotate, and includes a stepping motor which can change the rotation velocity. That is, in this embodiment, the conveying roller 8, the photosensitive drum 10*a* and the re-conveying roller 22 are rotated by a driving force of the main motor 16 transmitted through a drive transmitting portion (first drive transmitting portion) including the motor pulley 31, the drive belt 32 and the idler gears. The discharge roller 14 is rotated by the discharge driving motor 16*a* which is another driving source (second driving source) not by the main motor 16.

The driving operation of the discharge roller 14 is independent from the main motor 16 in this manner, the discharge roller 14, the re-conveying roller 22 and the conveying roller 8 can be driven independently. As a result, a sheet conveying velocity when the discharge roller 14 reversely rotates can be made slower than a sheet conveying velocity when the discharge roller 14 normally rotates irrespective of sheet conveying velocities of the re-conveying roller 22 and the conveying roller 8. In other words, the sheet conveying velocities of the re-conveying roller 22 and the conveying roller 8 can be set without any relation to the sheet conveying velocity of the discharge roller 14, and the sheet conveying velocity of the re-conveying roller 22 can be set slower than that of the conveying roller 8.

Next, the drive transmitting system from the discharge driving motor 16*a* will be described. The discharge driving motor 16*a* includes a motor pinion 38 which outputs a rotation driving force of the discharge driving motor 16*a*, and the motor pinion 38 is connected to a discharge roller drive gear 39 fixed to the discharge roller 14 through a ninth idler gear 49.

Since no clutch mechanism is provided between the discharge driving motor 16*a* and the discharge roller 14, switch between normal rotation and reverse rotation of the discharge driving motor 16*a* uniquely determines the rotation direction of the discharge roller 14. In this embodiment, the discharge driving motor 16*a* is drive-controlled such that the discharge driving motor 16*a* rotates in a direction of the arrow CW (clockwise direction) when a sheet is discharged of one-sided printing and duplex printing, and rotates in a direction CCW (counterclockwise direction) when a sheet is turned over of duplex printing.

Next, sheet conveying velocities of the conveying rollers of the printer body 100A concerning conveyance of a sheet will be described. The number of teeth of the motor pulley 31 is defined as $Z_{MM}$, the number of teeth of the drum drive gear 40 is defined as $Z_{DR}$, the number of teeth of the sheet feeding drive gear is defined as $Z_{PU}$, the number of teeth of the conveying roller drive gear 35 is defined as $Z_{FP}$ the number of teeth of the re-conveying roller drive gear is defined as $Z_{RF}$, and the number of teeth of the pressure roller drive gear 36 is defined as $Z_{PR}$. The number of teeth of the motor pinion 38 is defined as $Z_{DP}$, and the number of teeth of the discharge roller drive gear 39 is defined as $Z_{FD}$.

Outer diameters of rollers of the photosensitive drum 10*a*, the feeding roller 4, the conveying roller 8, the re-conveying roller 22, the pressure roller 12*b* and the discharge roller 14 are defined as $D_{DR}$, $D_{PU}$, $D_{FP}$, $D_{RF}$, $D_{PR}$ and $D_{FD}$. A deceleration ratio of the deceleration pulley 33 is defined as $F_{RD}$, and the number of rotations of the motor pulley 31 of the main motor 16 and the motor pinion 38 of the discharge driving motor 16*a* are defined as $R_{MM}$ and $R_{FD}$. The number of rotations and the sheet conveying velocities of the rollers are as shown in Table 1.

TABLE 1

| | Deceleration ratio | Outer diameter | Number of rotations | Conveying velocity |
|---|---|---|---|---|
| Feeding roller | $F_{RD} \times Z_{PU}/Z_{MM}$ | $D_{PU}$ | $R_{MM}/(F_{RD} \times Z_{PU}/Z_{MM})$ | $D_{PU} \times R_{MM}/(F_{RD} \times Z_{PU}/Z_{MM})$: $V_{PU}$ |
| Conveying roller | $F_{RD} \times Z_{FP}/Z_{MM}$ | $D_{FP}$ | $R_{MM}/(F_{RD} \times Z_{FP}/Z_{MM})$ | $D_{FP} \times R_{MM}/(F_{RD} \times Z_{FP}/Z_{MM})$: $V_{FP}$ |
| Photosensitive drum | $F_{RD} \times Z_{DR}/Z_{MM}$ | $D_{DR}$ | $R_{MM}/(F_{RD} \times Z_{DR}/Z_{MM})$ | $D_{DR} \times R_{MM}/(F_{RD} \times Z_{DR}/Z_{MM})$: $V_{DR}$ |
| Fixing pressure roller | $F_{RD} \times Z_{PR}/Z_{MM}$ | $D_{PR}$ | $R_{MM}/(F_{RD} \times Z_{PR}/Z_{MM})$ | $D_{PR} \times R_{MM}/(F_{RD} \times Z_{PR}/Z_{MM})$: $V_{PR}$ |
| Discharge roller | $F_{RD} \times Z_{FD}/Z_{DP}$ | $D_{FD}$ | $R_{FD}/(F_{RD} \times Z_{FD}/Z_{DP})$ | $D_{FD} \times R_{FD}/F_{RD} \times Z_{FD}/Z_{DP})$: $V_{FD1}/V_{FD2}$ |
| Re-conveying roller | $F_{RD} \times Z_{RF}/Z_{MM}$ | $D_{RF}$ | $R_{MM}/(F_{RD} \times Z_{RF}/Z_{MM})$ | $D_{RF} \times R_{MM}/(F_{RD} \times Z_{RF}/Z_{MM})$: $V_{RF}$ |

The sheet conveying velocities of the photosensitive drum 10*a*, the feeding roller 4, the conveying roller 8, the re-conveying roller 22 and the pressure roller 12*b* are defined as $V_{DR}$, $V_{PU}$, $V_{FP}$, $V_{RF}$ and $V_{PR}$. The sheet conveying velocity of the discharge roller 14 in the discharge direction is defined as $V_{FD1}$ and the sheet conveying velocity thereof in the reverse rotation direction is defined as $V_{FD2}$. In this embodiment, a relation of velocities of the rollers is $$V_{PU} \approx V_{FP} \approx V_{DR} < V_{PR} < V_{FD1} \quad (1)$$

$$V_{FD2} \approx V_{RF} \leq V_{FP} \quad (2)$$

Examples of setting of the outer diameters of the rollers and the number of teeth of the gears which can obtain the above-described sheet conveying velocities are shown in Table 2. In Table 2, calculation is carried out while setting the deceleration ratio of the deceleration pulley 33 to 4.

TABLE 2

| Roller/motor | Outer diameter (mm) | Number of teeth of gear | Number of rotations (rps) | Conveying velocity (mm/s) |
|---|---|---|---|---|
| Main motor | — | 14 | 9.10 | — |
| Feeding roller | 24 | 24 | 1.33 | 100.05 |

TABLE 2-continued

| Roller/motor | Outer diameter (mm) | Number of teeth of gear | Number of rotations (rps) | Conveying velocity (mm/s) |
|---|---|---|---|---|
| Conveying roller | 18 | 18 | 1.77 | 100.05 |
| Photosensitive drum | 24 | 24 | 1.33 | 100.05 |
| Fixing pressure roller | 18 | 17 | 1.87 | 105.93 |
| Motor pinion (discharge direction) | — | 14 | 2.50 | — |
| Discharge roller (discharge direction) | 10 | 10 | 3.50 | 109.96 |
| Motor pinion (discharge direction) | — | 14 | 2.10 | — |
| Discharge roller (reverse rotation direction) | 10 | 10 | 2.94 | 92.36 |
| Re-conveying roller | 14 | 15 | 2.12 | 93.38 |

By setting the sheet conveying velocity $V_{RF}$ of the re-conveying roller 22 slower than the sheet conveying velocity $V_{FP}$ of the conveying roller 8, a sheet does not form a loop between the rollers. The sheet conveying velocity $V_{RF}$ of the re-conveying roller and the sheet conveying velocity $V_{FD2}$ of the discharge roller 14 in the reverse rotation direction are set substantially equal to each other, or the sheet conveying velocity $V_{FD2}$ is set slower than the sheet conveying velocity $V_{RF}$. According to this, an excessively large loop is not generated between the discharge roller 14 and the re-conveying roller 22.

As described above, in this embodiment, the discharge roller 14 is driven by the discharge driving motor 16*a* which can normally and reversely rotate and which can change the rotation velocity. According to this, the sheet conveying velocity $V_{FD2}$ of the discharge roller 14 in the reverse rotation direction can be made slower than the sheet conveying velocity $V_{FD1}$ of the discharge roller 14 in the discharge direction. As a result, the sheet conveying velocity $V_{RF}$ of the re-conveying roller 22 can be made substantially equal to or slower than the sheet conveying velocity $V_{FP}$ of the conveying roller 8.

By setting the sheet conveying velocity of the re-conveying roller 22 in this manner, a sheet does not form a loop between the re-conveying roller 22 and the conveying roller 8. As a result, it is possible to avoid a case where a sheet slips in a state in which a rear end of the sheet is in abutment against the re-conveying roller 22 after the sheet passes through the re-conveying roller 22. According to this, even if a stain of the re-conveying roller 22 caused by fog toner at the time of printing of a first side develops, it is possible to carry out the duplex printing without generating a mark of the roller on the sheet.

By making the driving operation of the discharge roller 14 independent from the main motor 16, the sheet conveying velocity $V_{RF}$ of the re-conveying roller 22 and the sheet conveying velocity $V_{FD2}$ of the discharge roller 14 in the reverse rotation direction can be made substantially equal to each other. According to this, a printing side of a sheet does not rub against an inner surface of the conveying guide constituting the re-conveying path 21, and generation of an image stain can be avoided.

In this embodiment, to simplify the description, only the deceleration pulley 33 is described as a mechanism which decelerates the driving from the main motor 16 and transmits the same, but in addition to the deceleration pulley 33, finely adjusting deceleration gears may be added to front stages of the rollers. In the embodiment of the invention, although the driving of the motor pinion 38 and the driving of the discharge roller 14 are connected through the ninth idler gear 49, the ninth idler gear 49 may be omitted. Further, the motor pinion 38 and the discharge roller 14 may be directly connected to each other through a coupling, of course. On the contrary, a gear for deceleration may be added between the motor pinion 38 and the discharge roller 14. Although rotation of the main motor 16 is transmitted through the drive belt 32 in the embodiment, this may be changed to a gear train, of course.

Figure 3:
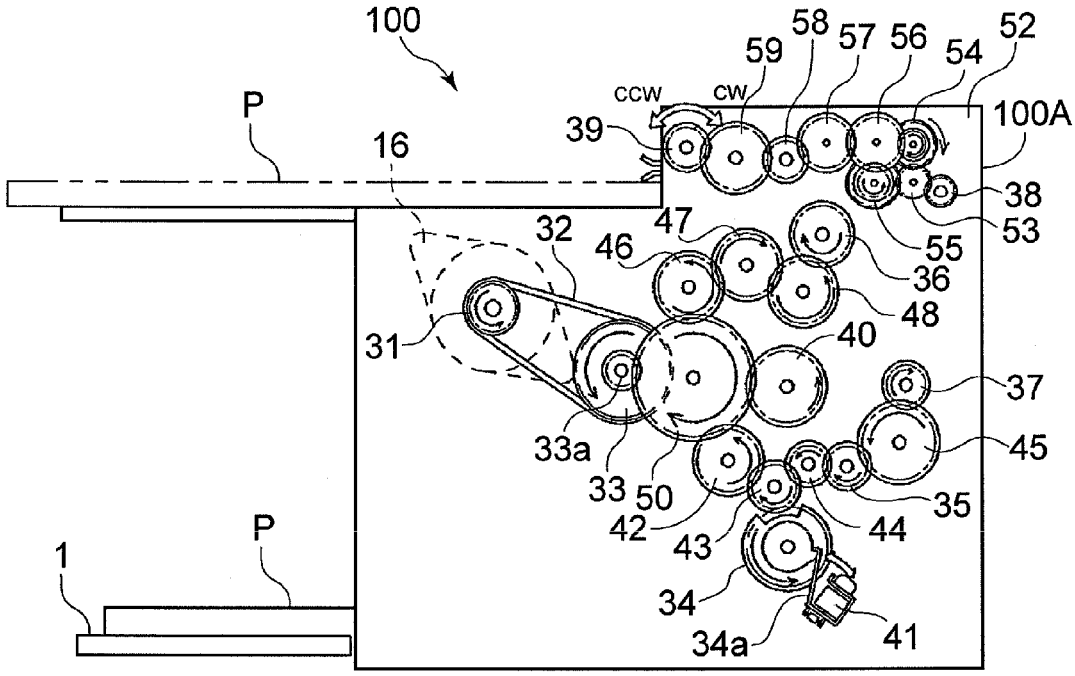
FIG. 3 is a diagram illustrating a drive transmitting system of a laser beam printer according to a second embodiment of the invention.

Next, a second embodiment of the invention will be described. FIG. 3 is a diagram illustrating a drive transmitting system of a laser beam printer as one example of an image forming apparatus according to this embodiment. In FIG. 3, the same symbols as those in FIG. 2 represent the same or corresponding portions.

FIG. 3 illustrates first and second deceleration gears 54 and 55, and the motor pinion 38 on the discharge driving motor 16*a* illustrated in FIG. 2 is connected through a drive transmitting portion including the first and second deceleration gears 54 and 55 and a tenth idler gear 53. Here, the second deceleration gear 54 transmits only a rotation driving force in a direction CW shown with the arrow, i.e., in a reverse rotation direction of the discharge roller 14 illustrated in FIG. 1. The first deceleration gear 55 selectively transmits only a rotation driving force in a direction CCW illustrated with the arrow, i.e., in a discharge direction of the discharge roller 14.

Figure 4:
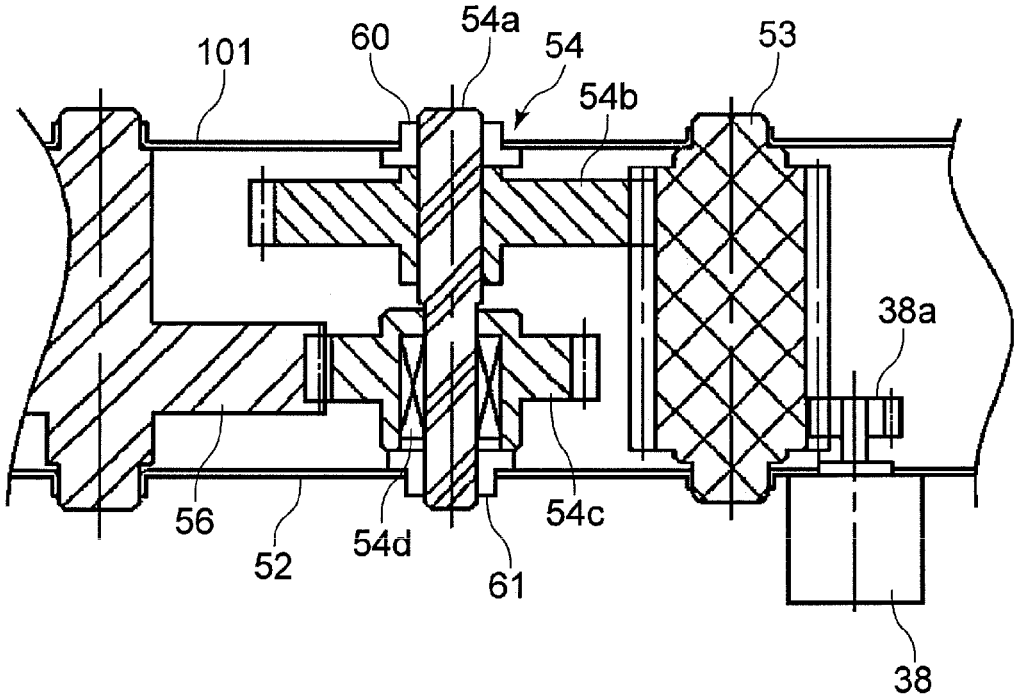
FIG. 4 is a diagram for explaining a configuration of a first deceleration gear provided in the drive transmitting system.

Next, a configuration of the second deceleration gear 54 will be described using FIG. 4 which is a sectional view of FIG. 3 as viewed from above. FIG. 4 illustrates a motor stay 52 and a side plate 101 of the printer body 100A, and the tenth idler gear 53, the second deceleration gear 54 and an eleventh idler gear 56 are disposed between the motor stay 52 and the side plate 101. The second deceleration gear 54 includes a rotation shaft 54*a* which is axially supported by a bearing 60 provided on the side plate 101 and by a bearing 61 provided on the motor stay 52, and an input gear 54*b* and an output gear 54*c* which are fixed to the rotation shaft 54*a* and which integrally rotate together with the rotation shaft 54*a*.

A one-way clutch 54*d* is fixed to an inner diameter of the output gear 54*c*. A needle (not illustrated) of the one-way clutch 54*d* is engaged with the rotation shaft 54*a* only when the input gear 54*b* rotates in the direction CW illustrated in FIG. 3, and the one-way clutch 54*d* transmits rotation to the output gear 54*c*. If input in which the input gear 54*b* rotates in the direction CCW is given, the one-way clutch 54*d* and the rotation shaft 54*a* idle. Therefore, the output gear 54*c* does not rotate and in this case, rotation in the direction CCW is not transmitted to a drive train disposed downstream of the second deceleration gear 54. Although the second deceleration gear 54 was described in FIG. 4, the first deceleration gear 55 also has the same configuration except that a drive transmitting direction of the one-way clutch 54*d* incorporated in the deceleration gear 54 is opposite.

Since the image forming apparatus includes the first and second deceleration gears 54 and 55 having this configuration, rotation output from the motor pinion 38 is transmitted to the tenth idler gear 53, the number of rotations of the tenth idler gear 53 is adjusted by the second deceleration gear 54 at the time of CCW. The number of rotations of the tenth idler gear 53 is adjusted by the first deceleration gear 55 at the time of CW. Drive of the discharge driving motor 16*a* whose number of rotations is adjusted through the second deceleration gear 54 or the first deceleration gear 55 is transmitted to eleven to fourteenth idler gears 56 to 59, and the discharge roller drive gear 39 fixed to the discharge roller 14 is driven ultimately.

In this embodiment, the discharge roller 14 is rotated in the discharge direction by the first deceleration gear 55 which constitutes a first gear mechanism having the input gear 54*b* and the one-way clutch 54*d*. The discharge roller 14 is rotated in the reverse rotation direction by the second deceleration gear 54 constituting a second gear mechanism having the same configuration.

If the number of rotations of the motor pinion 38 (discharge driving motor 16*a*) is the same in the discharge direction and the reverse rotation direction, the sheet conveying velocity of the discharge roller 14 can freely be set in the discharge direction and the reverse rotation direction by setting the number of teeth of the first and second deceleration gears 54 and 55. This embodiment is constituted such that if a deceleration ratio of the first deceleration gear 55 is set to R3 and deceleration ratios of the second deceleration gear 54 are set to R3 and R4, the deceleration radio becomes R3>R4.

By setting the deceleration ratios of the first and second deceleration gears 54 and 55 in this manner, the sheet conveying velocity of the discharge roller 14 in the discharge direction can be made faster than that of the conveying roller 8. Further, the sheet conveying velocity of the discharge roller 14 in the reverse rotation direction can be made slower than the sheet conveying velocity of the discharge roller 14 in the discharge direction. As a result, the sheet conveying velocity of the re-conveying roller 22 can be made substantially equal to the sheet conveying velocity of the discharge roller 14 in the reverse rotation direction.

Also in this embodiment, since the driving operation of the discharge roller 14 is independent from the main motor 16, the sheet conveying velocity of the re-conveying roller 22 can be made slower than the sheet conveying velocity of the conveying roller 8. According to this, a sheet does not form a loop between the re-conveying roller 22 and the conveying roller 8.

That is, since a transmission mechanism having different deceleration ratio of the motor pinion 38 according to normal and reverse rotation having the first and second deceleration gears 54 and 55 is provided in the drive system train which drives the discharge roller 14 as in this embodiment, the same effect as that of the first embodiment can be obtained. Further, since it is unnecessary to adjust the number of rotations of the motor pinion 38 in each of normal rotation and reverse rotation, it is easy to control. A DC motor which can only rotate normally and reversely can be used as the discharge driving motor instead of the stepping motor, it is possible to inexpensively provide a laser beam printer (image forming apparatus) capable of printing on both sides having little image disturbance.

Figure 5:
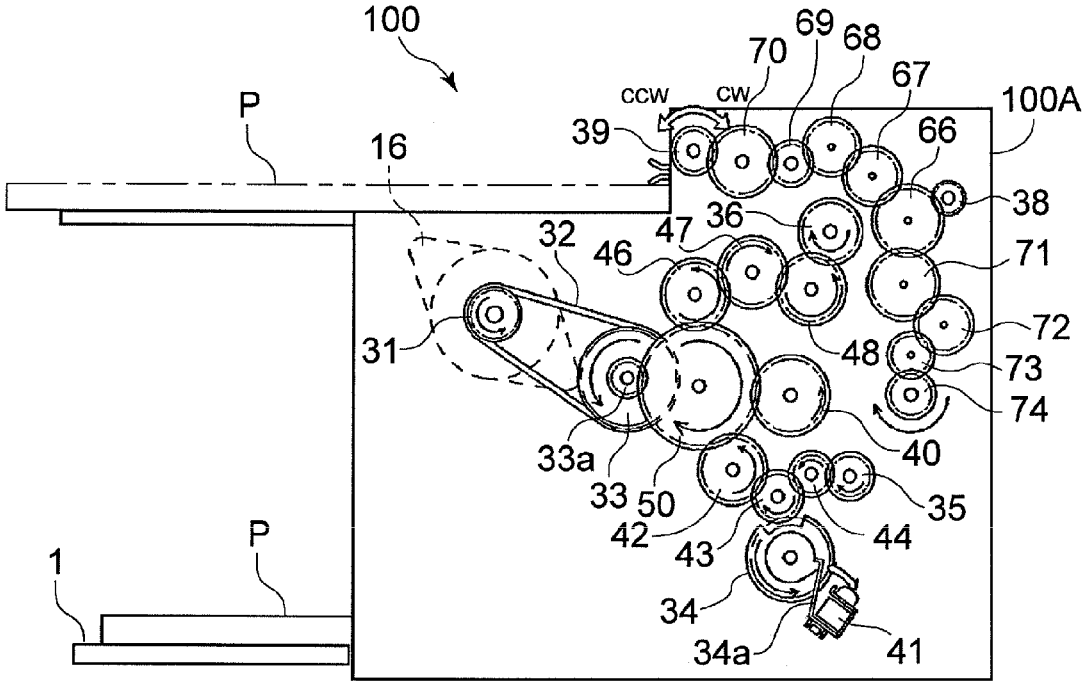
FIG. 5 is a diagram illustrating a drive transmitting system of a laser beam printer according to a third embodiment of the invention.

Next, a third embodiment of the invention will be described. FIG. 5 is a diagram illustrating a drive transmitting system of a laser beam printer as one example of an image forming apparatus according to this embodiment. In FIG. 5, the same symbols as those in FIG. 2 represent the same or corresponding portions.

FIG. 5 illustrates fifteenth to nineteenth idler gears 66 to 70. The motor pinion 38 on the discharge driving motor 16*a* illustrated in FIG. 2 is connected to the discharge roller drive gear 39 fixed to the discharge roller 14 through the fifteenth to nineteenth idler gears 66 to 70. Since no clutch mechanism is provided between the motor pinion 38 and the discharge roller 14, switch between normal rotation and reverse rotation of the motor pinion 38 uniquely determines the rotation direction of the discharge roller 14.

In this embodiment, rotation output from the motor pinion 38 is transmitted to the re-conveying roller gear 74 through twentieth to twenty-second idler gears 71 to 73. In this embodiment, a driving force of the discharge driving motor 16*a* is transmitted to the discharge roller 14 and the re-conveying roller 22 by a second drive transmitting portion including the idler gears. That is, in this embodiment, the discharge roller 14 and the re-conveying roller 22 are driven by the discharge driving motor 16*a* through the second drive transmitting portion.

This re-conveying roller gear 74 is connected to the re-conveying roller 22 through a one-way clutch gear (not illustrated) coaxially fixed to the re-conveying roller gear 74, and transmits a rotation driving force only in the direction CW shown with the arrow in the drawing. In this embodiment, when the discharge driving motor 16*a* CCW-rotates the motor pinion 38, the motor pinion 38 is rotated at two velocities. The two velocities concerning CCW rotation of the motor pinion 38 are defined as CCW1 and CCW2, respectively. Here, CCW1 is set equal to or faster than CW, and CCW2 is set to such a velocity that when the sheet conveying velocity of the re-conveying roller 22 is defined as V1 and the sheet conveying velocity of the conveying roller 8 is defined V2, a relation V1≤V2 is established.

Figure 6:
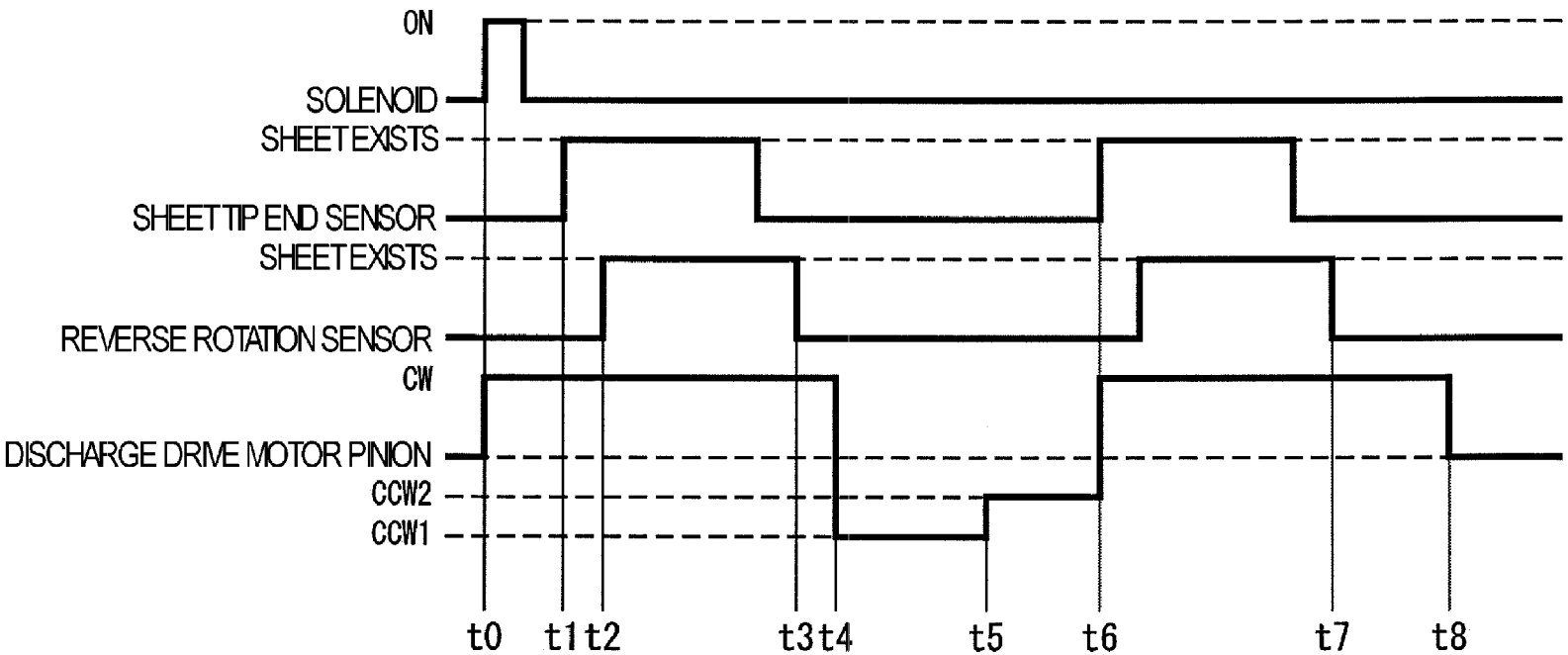
FIG. 6 is a timing chart illustrating operation sequence at the time of duplex printing of the laser beam printer.

Next, operation sequence at the time of duplex printing of the laser beam printer having the above-described configuration will be described using a timing chart which illustrates a state of time series of the solenoid 41, the sheet tip end sensor 9, the reverse-rotation sensor 18 and the motor pinion 38 illustrated in FIG. 6.

If the printer body 100A starts the image forming operation, the solenoid 41 is energized and turned ON (t0) and a sheet feeding operation by the feeding roller 4 is started. Next, if a sheet tip end passes through the sheet tip end sensor 9 (t1), then a toner image is formed on the photosensitive drum 10*a*, and this toner image is transferred to the sheet. The toner image is heated and pressed in the fixing portion 12 constituted by the fixing heating member 12*a* and the fixing pressure roller 12*b* and the toner image is permanently fixed onto the sheet. Next, if the sheet P passes through the reverse-rotation sensor 18 (t2), a tip end of the sheet P is once discharged from the printer body 100A through the discharge opening 20.

Next, the reverse-rotation sensor 18 does not detect existence of a sheet (t3) and then, if a given time is elapsed (t4), CW rotation of the motor pinion (discharge driving motor 16*a*) is switched to the CCW direction. The rotation velocity of the motor pinion at that time is set to CCW1. If the rotation velocity is set to CCW1, since the discharge roller 14 and the re-conveying roller 22 rotate at a velocity equal to or faster than CW, the productivity at the time of the turning over operation of a sheet can be enhanced.

Thereafter, if the sheet tip end passes through the re-conveying roller 22 and predetermined timing before the sheet tip end reaches the conveying roller 8 comes (t5), the number of rotations of the motor pinion 38 is switched from CCW1 to CCW2. If the number of rotations is set to CCW2, since the relation between the sheet conveying velocity V1 of the re-conveying roller 22 and the sheet conveying velocity V2 of the conveying roller 8 become V1≤V2, a sheet does not form a loop between the re-conveying roller 22 and the conveying roller 8.

Thereafter, the sheet P conveyed by the conveying roller 8 again reaches the sheet tip end sensor 9 (t6), rotation of the motor pinion 38 again returns to the CW rotation. At that time, if a long sheet whose rear end is nipped by the re-conveying roller 22 is fed, a state where a velocity difference is generated between the re-conveying roller 22 and the conveying roller 8 continues for a long time in some cases. However, the re-conveying roller 22 idles by the effect of the one-way clutch incorporated in the re-conveying roller gear 74. Therefore, a case where a rear end of a sheet and the re-conveying roller 22 pull each other is not generated by changing the number of rotations of the motor pinion 38. Then, if the reverse-rotation sensor 18 does not detect the existence of sheets again (t7), the motor pinion 38 rotates in the CW direction until the sheet rear end is completely discharged from the discharge opening 20 and then, the motor pinion 38 stops (t8).

As described above, in this embodiment, the discharge roller 14 is driven by the discharge driving motor 16*a* which can normally and reversely rotate and which can change the rotation velocity. According to this, the sheet conveying velocity of the discharge roller 14 in the reverse rotation direction can be made slower than the sheet conveying velocity of the discharge roller 14 in the discharge direction. Further, the discharge driving motor 16*a* drives not only the discharge roller 14 but also the re-conveying roller 22. According to this, the sheet conveying velocity of the re-conveying roller 22 can be made slower than the sheet conveying velocity of the conveying roller 8 immediately before the re-conveying roller 22 reaches the conveying roller 8, and a sheet does not form a loop between the re-conveying roller 22 and the conveying roller 8. When images are formed on both sides, the sheet can be conveyed at a high velocity until the sheet reaches the conveying roller 8 and as a result, it is possible to provide a laser beam printer (image forming apparatus) having high productivity.

Figure 7:
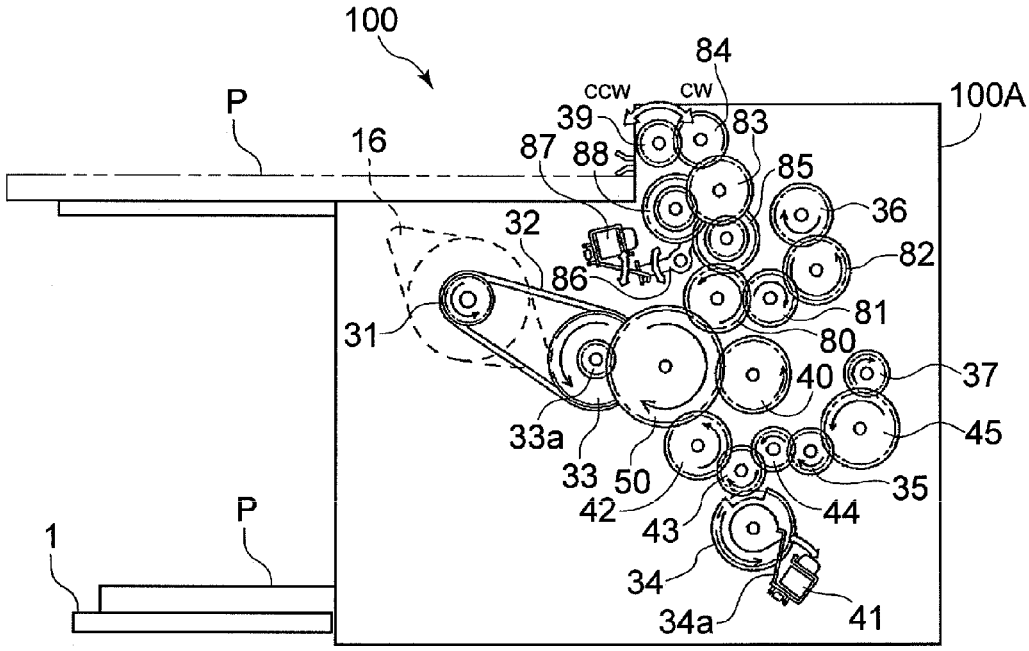
FIG. 7 is a diagram illustrating a drive transmitting system of a laser beam printer according to a fourth embodiment of the invention.

Next, a fourth embodiment of the invention will be described. FIG. 7 is a diagram illustrating a drive transmitting system of a laser beam printer as one example of an image forming apparatus according to this embodiment. In FIG. 7, the same symbols as those in FIG. 2 represent the same or corresponding portions.

In FIG. 7, a twenty-third idler gear 80 always rotates in the CCW direction by the main motor which rotates in one direction. Rotation of the twenty-third idler gear 80 is input to a second planetary gear unit 85 which is a second planetary gear mechanism for transmitting drive from the main motor 16 so that the discharge roller 14 can be rotated in the reverse rotation direction. The second planetary gear unit 85 is drive-connected to a twenty-fourth idler gear 83 and a first planetary gear unit 88 which is a first planetary gear mechanism for transmitting drive from the main motor 16 so that the discharge roller 14 can be rotated in the reverse rotation direction.

The first planetary gear unit 88 is also drive-connected to the twenty-fourth idler gear 83. An engaging projection 86 controls rotation operations of first and second planetary gear units 85 and 88, the engaging projection 86 is rotatably axially supported on the side plate 101, and is driven by a reversely rotatable solenoid 87 which is a switching member fixed to the side plate 101. The twenty-fourth idler gear 83 drives the discharge roller 14 through a twenty-fifth idler gear 84 and the discharge roller drive gear 39.

Figure 8:
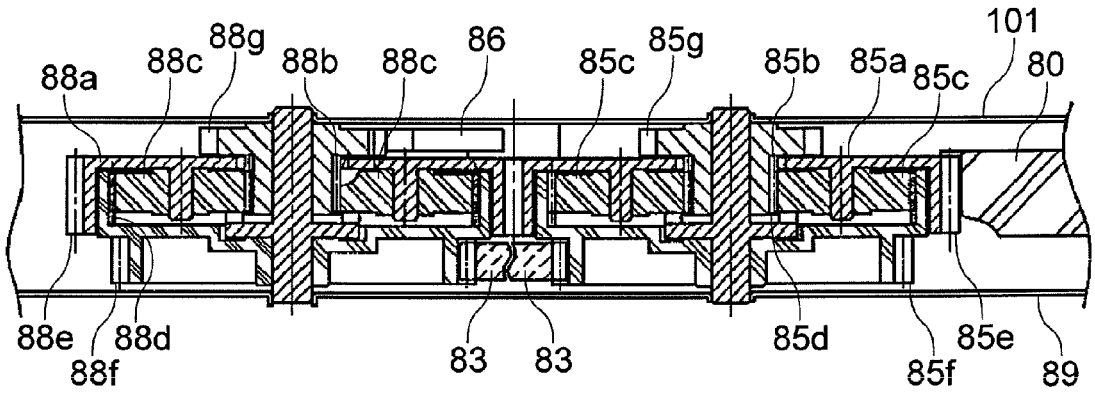
FIG. 8 is a diagram for explaining details of configurations of first and second planetary gear units provided in the drive transmitting system.

Next, detailed configurations of the first and second planetary gear units 85 and 88 will be described using FIG. 8. FIG. 8 is a sectional view of the first and second planetary gear units 85 and 88 as viewed from above. Entire configurations of the first and second planetary gear units 85 and 88 are the same except that the number of teeth of a gear constituting the planetary gear mechanism and the number of teeth of input/output gears are different. Therefore, the second planetary gear unit 85 will be described in detail.

The second planetary gear unit 85 includes a carrier 85*a* which is axially supported by a shaft 85A between a drive side plate 89 and the side plate 101, and which rotatably axially supports two planetary gears 85*c*. The planetary gear 85*c*, the sun gear 85*b* and the ring gear 85*d* which mesh with the planetary gear 85*c* are rotatably axially supported by the carrier 85*a* coaxially. A ratchet 85*g* which is an engaging portion is formed on the sun gear 85*b*. An input gear 85*e* is integrally formed on an outer periphery of the carrier 85*a*, and an output gear 85*f* is integrally formed on an outer periphery of the ring gear 85*d*.

If the ratchet 85*g* of the second planetary gear unit 85 is engaged with the engaging projection 86, the sun gear 85*b* is locked, and the second planetary gear unit 85 functions as a planetary gear mechanism which is classified into a solar type. Since the first planetary gear unit 88 whose engagement with the engaging projection 86 is released is not fixed to any of a sun gear 88*b*, a carrier 88*a* and a ring gear 88*d*, the first planetary gear unit 88 functions as an idler gear which does not transmit a driving force.

Figure 9A:
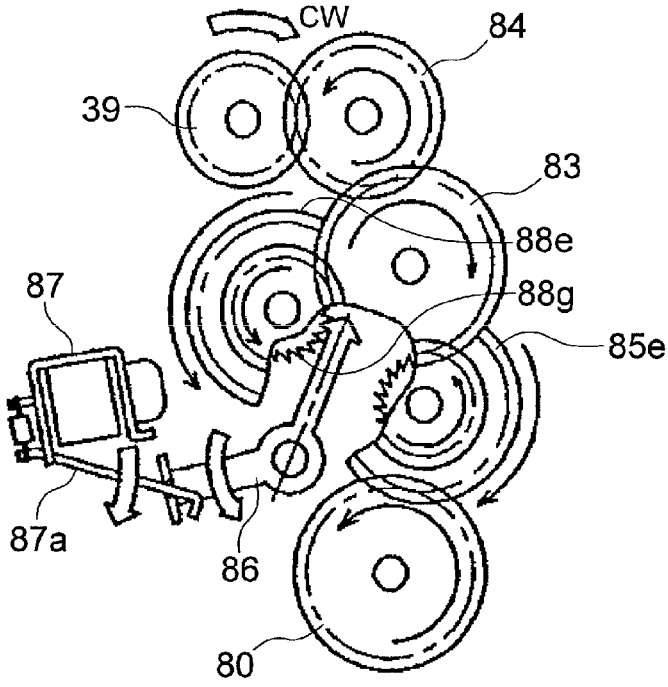
FIGS. 9A and 9B are diagrams for explaining a clutch mechanism provided on the drive transmitting system.
Figure 9B:
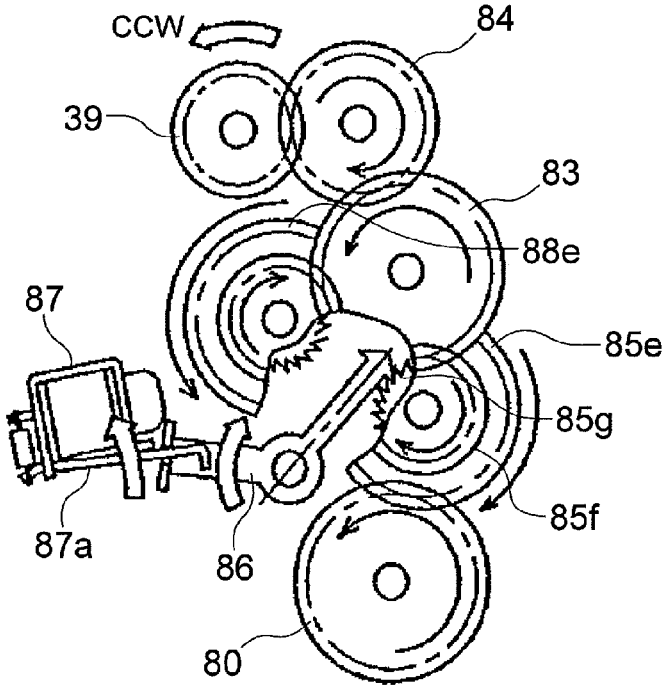

Next, a clutch mechanism by the engaging projection 86 will be described using FIG. 9. FIGS. 9A and 9B are partial enlarged views of a drive series to the discharge roller drive gear 39. FIG. 9A is an operation diagram when the discharge roller 14 rotates in the discharge direction, and FIG. 9B is an operation diagram when the discharge roller 14 rotates in the reverse rotation direction.

First, the operation when the discharge roller 14 rotates in the discharge direction will be described. The reversely rotatable solenoid 87 is not energized, and an actuator 87*a* is in a home position illustrated in FIG. 9A. The reversely rotatable solenoid 87 constitutes an input switching portion which inputs a driving force from the main motor 16 to the first planetary gear unit 88 when the discharge roller 14 is normally rotated together with the engaging projection 86, and which inputs the driving force from the main motor 16 to the second planetary gear unit 85 when the discharge roller 14 is reversely rotated. At that time, the engaging projection 86 is biased in a direction of the arrow in the drawing. The engaging projection 86 is engaged with a ratchet 88*g* which is integrally formed on the sun gear 88*b* of the first planetary gear unit 88, and locks the sun gear 88*b*. At that time, since the sun gear 85*b* of the second planetary gear unit 85 is brought into a free state where the sun gear 85*b* is not fixed, the sun gear 85*b* functions as an idler gear which does not transmits a driving force.

According to this, a rotation driving force shown with the arrow from the twenty-third idler gear 80 which is a drive input gear is transmitted from the input gear 85*e* of the carrier 85*a* of the second planetary gear unit 85 to an input gear 88*e* of the carrier 88*a* of the first planetary gear unit 88. If the carrier 88*a* rotates, this rotation is transmitted as shown with the arrow illustrated in FIG. 9A, and the rotation is transmitted to the twenty-fourth idler gear which meshes with an output gear 88*f* which is an output gear. As a result, the discharge roller drive gear 39 which meshes with the twenty-fourth idler gear 83 rotates in the CW direction, i.e., in the discharge direction.

Next, if the reversely rotatable solenoid 87 is energized, an actuator 87*b* is sucked in a direction of the arrow illustrated in FIG. 9B. According to this, the engaging projection 86 rotates in a direction of the arrow, and is engaged with the ratchet 85*g* which is integrally formed on the sun gear 85*b* of the second planetary gear unit 85, thereby locking the sun gear 85*b*. Therefore, the first planetary gear unit 88 functions as an idler gear which does not transmit a driving force.

According to this, a rotation driving force from the twenty-third idler gear 80 is transmitted to the input gear 85*e* of the carrier 85*a* of the second planetary gear unit 85, and the carrier 85*a* rotates. The rotation of the carrier 85*a* is transmitted as indicated by the arrow illustrated in FIG. 9B, and the rotation is transmitted to the twenty-fourth idler gear 83 which meshes with the output gear 85*f*. As a result, the discharge roller drive gear 39 which meshes with the twenty-fourth idler gear 83 rotates in the CCW direction, i.e., in the reverse rotation direction. The outlines of the discharging operation and the reversely rotation of the discharge roller 14 are as described above.

In this embodiment, when the deceleration ratios of the first and second planetary gear units 85 and 88 are defined as R5 and R6, a relation R5>R6 is established. Table 3 shows examples of the settings of the number of teeth and the like of the first and second planetary gear units 85 and 88 and the setting of the number of teeth of the gear of the drive system.

TABLE 3

| | Sun gear (85b, 88b) | Planetary gear (85c, 88c) | Ring gear (88d, 88d) | Input gear (85e, 88e) | Output gear (85f, 88f) | Deceleration ratio |
|---|---|---|---|---|---|---|
| First planetary gear unit | 16 | 16 | 48 | 48 | 39 | 0.92 |
| Second planetary gear unit (when rotating reversely) | 16 | 16 | 48 | 51 | 36 | 1.06 |

By adjusting the gear ratios of the input gears 85*e* and 88*e* and the output gears 85*f* and 88*f* in this manner, the sheet conveying velocity of the discharge roller 14 at the time of discharge can be made greater than that at the time of reverse rotation. Even if the number of teeth of the sun gears 85*b* and 88*b* and the planetary gears 85*c* and 88*c* of the first and second planetary gear units 85 and 88 are set as shown in Table 4, the sheet conveying velocity of the discharge roller 14 at the time of discharge can be made greater than that at the time of reverse rotation.

TABLE 4

| | Sun gear (85b, 88b) | Planetary gear (85c, 88c) | Ring gear (88d, 88d) | Input gear (85e, 88e) | Output gear (85f, 88f) | Deceleration ratio |
|---|---|---|---|---|---|---|
| First planetary gear unit | 24 | 15 | 54 | 48 | 36 | 0.92 |
| Second planetary gear unit (when rotating reversely) | 14 | 20 | 54 | 48 | 36 | 1.06 |

By such setting, sheet conveying velocities of the rollers of the printer body 100A are as shown in Table 5 when the number of rotations of the main motor is set to 9.10 RPS and the deceleration ratio of the deceleration pulley 33 is set to 4, for example.

TABLE 5

| Roller/motor | Outer diameter (mm) | Number of teeth of gear | Number of rotations (rps) | Conveying velocity (mm/s) |
|---|---|---|---|---|
| Main motor | — | 14 | 9.10 | — |
| Feeding roller | 24 | 24 | 1.33 | 100.05 |
| Conveying roller | 18 | 18 | 1.77 | 100.05 |
| Photosensitive roller | 24 | 24 | 1.33 | 100.05 |
| Fixing pressure roller | 18 | 17 | 1.87 | 105.93 |
| Discharge roller (discharge direction) | 10 | 10 | 3.46 | 108.75 |
| Discharge roller (reverse rotation direction) | 10 | 10 | 2.95 | 92.64 |
| Re-conveying roller | 14 | 15 | 2.12 | 93.38 |

As described above, in this embodiment, a driving force of the main motor 16 which rotates in one direction is transmitted to the discharge roller 14 through the first and second planetary gear units 85 and 88 having different deceleration ratios. According to this, the sheet conveying velocity of the discharge roller 14 in the reverse rotation direction can be made slower than the sheet conveying velocity of the discharge roller 14 in the discharge direction. As a result, the sheet conveying velocity of the re-conveying roller 22 can be made slower than that of the conveying roller 8, and it is possible to inexpensively provide a laser beam printer (image forming apparatus) having little image disturbance.

In the above description, when images are formed on both sides, the discharge roller is described as one example of the reversely-rotatable roller which normally rotates to convey a sheet by a predetermined distance at the sheet conveying velocity which is faster than the sheet conveying velocity of the conveying roller and then, the reversely-rotatable roller reversely rotates. However, the invention is not limited to this, and when the image forming apparatus includes a reversely-rotatable roller having the above-described function in addition to the discharge roller, the invention can be applied to this reversely-rotatable roller.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-295161, filed Dec. 25, 2009, which is hereby incorporated by reference herein in its entirety.

What is claimed is:

1. An image forming apparatus comprising:

an image forming portion;

a conveying roller which is provided upstream of the image forming portion in a sheet conveying direction, and which conveys a sheet to the image forming portion;

a re-conveying path which guides, to the image forming portion, a sheet having an image formed on its one side by the image forming portion;

a reversely-rotatable roller which is provided downstream of the image forming portion in the sheet conveying direction, which normally rotates and conveys the sheet having the image formed on its one side at a first velocity that is faster than a sheet conveying velocity of the conveying roller and then, which reversely rotates and conveys the same sheet to the re-conveying path at a second velocity that is slower than the first velocity; and a re-conveying roller which is provided on the re-conveying path, and which conveys the sheet reversely-conveyed by the reversely-rotated roller to the conveying roller, wherein a sheet conveying velocity of the re-conveying roller is faster than the second velocity of the reversely-rotatable roller when the reversely-rotatable roller and the re-conveying roller convey the same sheet, and the sheet conveying velocity of the conveying roller is faster than the sheet conveying velocity of the re-conveying roller when the re-conveying roller and the conveying roller convey the same sheet.

2. The image forming apparatus according to claim 1, further comprising:

a driving source which drives the reversely-rotatable roller, and which can normally and reversely rotate and can change its rotation velocity; and a controlling portion which controls the driving source such that a sheet conveying velocity of the reversely-rotatable roller is set to the first velocity that is faster than the sheet conveying velocity of the conveying roller by normal rotation of the driving source, and the sheet conveying velocity of the reversely-rotatable roller is set to the second velocity that is slower than the first velocity by reverse rotation of the driving source.

3. The image forming apparatus according to claim 1, further comprising:

a driving source which drives the reversely-rotatable roller and which can normally and reversely rotate; and a drive transmitting portion which transmits normal rotation of the driving source to the reversely-rotatable roller to set a sheet conveying velocity of the reversely-rotatable roller to the first velocity, and which transmits reverse rotation of the driving source to the reversely-rotatable roller to set the sheet conveying velocity of the reversely-rotatable roller to the second velocity that is slower than the first velocity.

4. The image forming apparatus according to claim 3, wherein the drive transmitting portion includes a first gear mechanism which transmits normal rotation of the driving source to the reversely-rotatable roller to normally rotate the reversely-rotatable roller, and a second gear mechanism which transmits reverse rotation to the reversely-rotatable roller to reversely rotate the reversely-rotatable roller, and which has a deceleration ratio greater than that of the first gear mechanism.

5. The image forming apparatus according to claim 1, further comprising:

a first driving source which drives the conveying roller;

a second driving source which drives the reversely-rotatable roller and the re-conveying roller, and which can normally and reversely rotate and can change its rotation velocity; and a drive transmitting portion which, when the second driving source normally rotates, transmits normal rotation to the reversely-rotatable roller to set a sheet conveying velocity of the reversely-rotatable roller to the first velocity, and which, when the second driving source reversely rotates, transmits reverse rotation to the reversely-rotatable roller and the re-conveying roller to set the sheet conveying velocity of the reversely-rotatable roller to the second velocity that is slower than the first velocity, and which makes the sheet conveying velocity of the re-conveying roller substantially equal to or slower than that of the conveying roller.

6. The image forming apparatus according to claim 5, wherein the second driving source makes the sheet conveying velocity of the reversely-rotatable roller substantially equal to or slower than that of the re-conveying roller until a sheet conveyed to the re-conveying path reaches the conveying roller after the sheet reaches the re-conveying roller.

7. The image forming apparatus according to claim 1, further comprising:

a driving source which drives the conveying roller, the re-conveying roller and the reversely-rotatable roller; and a drive transmitting portion which is provided between the driving source and the reversely-rotatable roller, and which transmits a driving force of the driving source to the reversely-rotatable roller, wherein the drive transmitting portion transmits a driving force of the driving source to the reversely-rotatable roller such that the first velocity of the reversely-rotatable roller when it normally rotates becomes faster than the sheet conveying velocity of the conveying roller, and the drive transmitting portion also transmits the driving force of the driving source to the reversely-rotatable roller such that the second velocity of the reversely-rotatable roller when it reversely rotates becomes slower than the first velocity of the reversely-rotatable roller when the reversely-rotatable roller normally rotates.

8. The image forming apparatus according to claim 7, wherein the drive transmitting portion includes:

a first planetary gear mechanism which transmits a driving force from the driving source to the reversely-rotatable roller to normally rotate the reversely-rotatable roller;

a second planetary gear mechanism which transmits a driving force from the driving source to the reversely-rotatable roller to reversely rotate the reversely-rotatable roller, and which has a deceleration ratio greater than that of the first planetary gear mechanism; and an input switching portion which inputs a driving force to the first planetary gear mechanism when the reversely-rotatable roller is normally rotated, and which inputs the driving force to the second planetary gear mechanism when the reversely-rotatable roller is reversely rotated.

9. The image forming apparatus according to claim 8, wherein the input switching portion includes:

an engaging projection which is engaged with sun gears of the first planetary gear mechanism and the second planetary gear mechanism; and a switching member which brings the engaging projection into engagement with the sun gear of the first planetary gear mechanism when the reversely-rotatable roller is normally rotated, and which brings the engaging projection into engagement with the sun gear of the second planetary gear mechanism when the reversely-rotatable roller is reversely rotated.

10. The image forming apparatus according to claim 7, further comprising a fixing portion which fixes an image formed on a sheet by the image forming portion to the sheet, wherein the fixing portion is driven by a driving force from the driving source such that the fixing portion conveys the sheet at a sheet conveying velocity slower than that of the reversely-rotatable roller when the reversely-rotatable roller normally rotates.

11. The image forming apparatus according to claim 10, wherein the reversely-rotatable roller is provided downstream of the fixing portion in the sheet conveying direction or at a position where the sheet is conveyed at the same time with the fixing portion, and the re-conveying roller is provided at a position where the sheet is conveyed at the same time with the reversely-rotatable roller which reversely rotates or at a position where the sheet is conveyed at the same time with the conveying roller.

12. The image forming apparatus according to claim 1, comprising:

a driving motor which drives the reversely-rotatable roller;

a first drive transmitting portion which transmits a driving force of the driving motor to the reversely-rotatable roller such that the first velocity of the reversely-rotatable roller is made faster than the sheet conveying velocity of the fixing portion when the reversely-rotatable roller normally rotates; and a second drive transmitting portion which transmits a driving force of the driving motor to the reversely-rotatable roller such that the second velocity of the reversely-rotatable roller is made slower than the first velocity when the reversely-rotatable roller reversely rotates.

13. The image forming apparatus according to claim 12, comprising:

a switching portion which performs switching between a state where a driving force of the driving motor is input to the first drive transmitting portion to make the reversely-rotatable roller normally rotate and a state where a driving force of the driving motor is input to the second drive transmitting portion to make the reversely-rotatable roller reversely rotate.

14. The image forming apparatus according to claim 13, further comprising a fixing portion which fixes an image formed on a sheet by the image forming portion to the sheet, wherein the fixing portion is driven by a driving force from a driving motor which drives the reversely-rotatable roller such that the fixing portion conveys the sheet at a sheet conveying velocity slower than that of the reversely-rotatable roller when the reversely-rotatable roller normally rotates, and a rotation direction of the reversely-rotatable roller is switched by the switching portion when the fixing portion is driven by a rotation of the driving motor in one direction.

15. The image forming apparatus according to claim 1, further comprising a fixing portion which fixes an image formed on a sheet by the image forming portion to the sheet while the sheet is conveyed at a fixing velocity, wherein a first velocity at which the re-conveying roller conveys the sheet in a first direction is faster than the fixing velocity, and the sheet conveying velocity of the conveying roller is slower than the fixing velocity.

* * * * *